US008089014B2

(12) United States Patent
Maeda et al.

(10) Patent No.: US 8,089,014 B2
(45) Date of Patent: Jan. 3, 2012

(54) WATERPROOF PUSH BUTTON SWITCH

(75) Inventors: Seiji Maeda, Toyama (JP); Morio Tada, Toyama (JP)

(73) Assignee: Hokuriku Electric Industry Co., Ltd., Toyama-shi (JP)

( * ) Notice: Subject to any disclaimer, the term of this patent is extended or adjusted under 35 U.S.C. 154(b) by 398 days.

(21) Appl. No.: 12/443,325

(22) PCT Filed: Sep. 27, 2007

(86) PCT No.: PCT/JP2007/068745

§ 371 (c)(1),
(2), (4) Date: Mar. 27, 2009

(87) PCT Pub. No.: WO2008/038690

PCT Pub. Date: Apr. 3, 2008

(65) Prior Publication Data

US 2010/0072046 A1 Mar. 25, 2010

(30) Foreign Application Priority Data

Sep. 29, 2006 (JP) ..... 2006-267230

(51) Int. Cl.
*H01H 13/06* (2006.01)

(52) U.S. Cl. ..... 200/302.1; 200/302.2; 200/341; 200/345

(58) Field of Classification Search ..... 200/406, 200/516, 517, 302.1, 302.2, 302.3, 341, 344, 200/345; 29/622
See application file for complete search history.

(56) References Cited

U.S. PATENT DOCUMENTS

| | | | | | |
|---|---|---|---|---|---|
| 4,349,693 | A | | 9/1982 | Hinrichs | |
| 4,412,113 | A | * | 10/1983 | Mitsugi et al. | 200/406 |
| 4,897,516 | A | * | 1/1990 | Wakatsuki | 200/302.2 |
| 5,199,555 | A | * | 4/1993 | Hirano | 200/341 |
| 5,199,557 | A | * | 4/1993 | Brandt et al. | 200/406 |
| 5,280,146 | A | * | 1/1994 | Inagaki et al. | 200/341 |
| 5,471,022 | A | * | 11/1995 | Kiss et al. | 200/83 B |
| 5,660,272 | A | * | 8/1997 | Janniere et al. | 200/517 |

(Continued)

FOREIGN PATENT DOCUMENTS

CN 1619796 A 5/2005

(Continued)

*Primary Examiner* — Michael Friedhofer
(74) *Attorney, Agent, or Firm* — Rankin, Hill & Clark LLP

(57) ABSTRACT

A waterproof push button switch does not need to be covered with a resin to a height at which a divided connected portion of a case for the switch is hidden by the resin in a height direction and the divided connected portion may be waterproofed. A gap (55, 57) is formed between a peripheral wall portion 7*b* of a base case 7 and a second cylindrical wall portion 9*b* of a cover case 9, and between an opposite surface 41 of the cover case 9 and a waterproofing seal member 11. The gap (55, 57) extends from an opening portion of the base case fitting chamber 37 to an annular watertight seal portion 51 to completely surround a periphery of the watertight seal portion 51. The thickness of the gap portion 55 is determined so that the resin entered into the gap portion 55 from an opening portion 37*a* of the base case fitting chamber 37 reaches the watertight seal portion 51 by surface tension.

6 Claims, 14 Drawing Sheets

U.S. PATENT DOCUMENTS

| | | | | |
|---|---|---|---|---|
| 5,890,586 | A * | 4/1999 | Adelhardt et al. | 200/302.1 |
| 5,939,685 | A * | 8/1999 | Matsuhashi | 200/61.41 |
| 7,485,825 | B2 * | 2/2009 | Nishikawa et al. | 200/520 |
| 7,740,166 | B2 * | 6/2010 | Takeuchi | 235/375 |
| 7,764,936 | B2 * | 7/2010 | Nakasono et al. | 455/128 |
| 2003/0026941 | A1 | 2/2003 | Togawa et al. | |
| 2004/0049363 | A1 | 3/2004 | Shimizu et al. | |
| 2005/0104189 | A1 | 5/2005 | Akagawa et al. | |
| 2008/0036094 | A1 | 2/2008 | Yoneda | |

FOREIGN PATENT DOCUMENTS

| | | |
|---|---|---|
| GB | 2080628 | 2/1982 |
| JP | 59-17523 | 2/1984 |
| JP | 1-60419 | 4/1989 |
| JP | 10-334759 | 12/1998 |
| JP | 2005-197045 | 7/2005 |

* cited by examiner

WATERPROOF PUSH BUTTON SWITCH

TECHNICAL FIELD

The present invention relates to a waterproof push button switch suitable for use at a location such as on a washing machine, a dish washer, or the like, for example, which may be exposed to water.

BACKGROUND ART

In a conventional waterproof push button switch of this type, a plurality of terminal portions protruding from the bottom portion of the switch are soldered and then electrically connected to a circuit pattern of a circuit substrate after having been passed through through-holes of the circuit substrate. On a surface of the circuit substrate, other electronic components are also mounted. When water adheres to a connected portion between the circuit substrate and the waterproof push button switch or other electronic components, a short-circuit accident or the like may occur. Thus, the substrate surface of the circuit substrate is covered with a resin in order to provide waterproofing to the connected portion. Waterproofing is thereby achieved. A case for the switch may comprise divided parts and have a connection formed between divided parts at a position midway in a direction of height or a height direction of the case. Accordingly, water may enter through the connection formed between the divided parts as well. The waterproof push button switch is therefore covered with the resin to a height at which the connection formed between the divided parts of the case is hidden by the resin, as disclosed in Japanese Patent Publication No. 2005-197045 FIG. 4

DISCLOSURE OF THE INVENTION

Problems to be Solved by the Invention

However, in the waterproof push button switch of this structure mounted on the circuit substrate, the switch is needed to be covered with the resin to the height at which the connection formed between the divided parts midway in the height direction of the case for the switch is hidden by the resin. Thus, an amount of the resin to be used becomes extremely large. The cost may accordingly be increased and the weight of the circuit substrate with the electronic components mounted thereon may therefore increase.

An object of the present invention is to provide a waterproof push button switch which does not need to be covered with a resin to a height at which a connection formed between the divided parts midway in a height direction of a case for the switch is hidden by the resin, and in which the connection may also be waterproofed.

Another object of the present invention is to provide a waterproof push button switch in which a resin may be satisfactorily sucked up along a peripheral wall of a base case, and the base case and a cover case may be satisfactorily coupled when the base case is fitted into the cover case.

Another object of the present invention is to provide a waterproof push button switch in which an outer periphery of a waterproofing seal member located at a connection formed between the divided parts midway in a direction of height of a case may be readily covered with a resin.

Another object of the present invention is to provide a waterproof button switch capable of preventing relative rotation in a peripheral direction between abase case and a cover case.

Still another object of the present invention is to provide a waterproof button switch in which a connection between base case and cover case may be further satisfactorily sealed, and a resin that has risen along a peripheral wall of the base case may be prevented from entering into the cover case.

Means for Solving the Problems

A waterproof push button switch of the present invention comprises a push button member that receives a pushing force when operated. This push button member is in a first position when a pushing force is not applied, and is linearly moved from the first position to a second position when the pushing force is applied. The waterproof push button switch further comprises a switch mechanism that is operated by this push button member. This switch mechanism is turned on by the force applied from the push button member when the push button member is in the second position, and is turned off when the push button member is not in the second position. The waterproof push button switch further comprises a base case provided with a switch mechanism receiving chamber that receives the switch mechanism. This base case comprises a bottom wall portion and a cylindrical peripheral wall portion, and the switch mechanism receiving chamber is formed in an interior portion surrounded by these bottom wall and cylindrical peripheral wall portions. The switch mechanism receiving chamber in this base case has an opening portion that opens in a direction where the push button member is located. The waterproof push button switch further comprises a cover case that covers the opening portion of the base case. This cover case has a through-hole through which a part of the push button member slidably passes, and comprises: a first cylindrical wall portion including a push button receiving chamber continuously formed with this through-hole and slidably receiving the part of the push button member; a second cylindrical wall portion integrally formed with the first cylindrical wall portion and including a base case fitting chamber that is continuously formed with the push button receiving chamber and opens to a side opposite to the through-hole; and an annular opposite surface that is formed at a boundary portion between the first cylindrical wall portion and the second cylindrical wall portion and faces an end surface of the peripheral wall portion of the base case. The waterproof push button switch further comprises a waterproofing seal member that is elastic. The waterproofing seal member is arranged and compressed between the end surface of the peripheral wall portion of the base case and the opposite surface of the cover case to cover the opening portion of the base case. The waterproof push button switch further comprises a coupling mechanism that couples the base case and the cover case. The coupling mechanism is structured to couple the second cylindrical wall portion of the cover case and the peripheral wall portion of the base case, with the base case fitted into the base case fitting chamber of the cover case. The thickness of the waterproofing seal member and the structure of the coupling mechanism are determined so that the waterproofing seal member is compressed to form an annular watertight seal portion between the end surface of the peripheral wall portion of the base case and the opposite surface of the cover case, with the base case fitted into the base case fitting chamber.

In the waterproof push button switch of the present invention in particular, a gap is formed between the peripheral wall portion of the base case and the second cylindrical wall portion of the cover case and between the opposite surface and the waterproofing seal member. The gap extends from an opening portion of the base case fitting chamber to the annular watertight seal portion to completely surround the watertight seal portion. The thickness of the gap is determined to allow a resin entered into the gap from the opening portion of the base case fitting chamber to reach the watertight seal portion by surface tension.

In the waterproof push button switch described above, the gap that extends from the opening portion of the base case fitting chamber to the annular watertight seal portion to completely surround the watertight seal portion is formed between the peripheral wall portion of the base case and the second cylindrical wall portion of the cover case and between the opposite surface and the waterproofing seal member. Then, the thickness of the gap is determined to allow the resin entered into the gap from the opening portion of the base case fitting chamber to reach the watertight seal portion by surface tension. Accordingly, when an end of the second cylindrical wall portion of the cover case enters into a surface of the resin at a time of mounting the waterproof push button switch on a circuit substrate together with other electronic components and then covering surfaces of the circuit substrate with the resin, the resin rises through the gap between the peripheral wall portion of the base case and the second cylindrical wall portion of the cover case by the surface tension. The resin thereby completely surrounds the watertight seal portion. For this reason, the covering thickness of the resin that covers the surfaces of the circuit substrate should be a depth at which the end of the second cylindrical wall portion of the cover case is embedded in the resin. Thus, it is not necessary to cover the waterproof push button switch with the resin to a height at which a connection midway in the direction of height of the case for the switch is hidden by the resin. The amount of the resin to be used may be thereby reduced, and the cost may be therefore reduced. In this waterproof push button switch in particular, the gap that receives the resin is provided between the annular opposite surface of the cover case and the waterproofing seal member. Accordingly, the waterproofing seal member is completely surrounded by and covered with the resin entered into this gap. Sealing may be thereby ensured.

A plurality of window portions that communicate with the base case fitting chamber may be formed in the second cylindrical wall portion of the cover case in a peripheral direction of the second cylindrical wall portion at predetermined intervals, these window portions serve as air vent holes. The resin may be thereby satisfactorily sucked up along a peripheral wall of the base case.

The cover case is flexible because the cover case is integrally formed of a flexible synthetic resin material. A plurality of engaging projections are formed integrally with and outwardly from the peripheral wall portion of the base case. The engaging projections deform the second cylindrical wall portion to push it radially outwardly when the base case gets fitted into the base case fitting chamber, and are fitted in the window portions and engaged with borders of the window portions when the base case is completely fitted into the base case fitting chamber. Then, the coupling mechanism is constituted from the borders of the window portions and the engaging projections. With this arrangement, when the base case is fitted into the cover case, the base case and the cover case may be satisfactorily coupled.

When the window portions are formed to expose a part of an outer peripheral surface of the waterproofing seal member therefrom, an outer periphery of the waterproofing seal member that is present at the connection formed between the divided parts midway in the height direction of the case may also be readily covered with the resin.

The window portions comprise n window portions formed at positions spaced by 360°/n (n being an integer not less than two) in the peripheral direction. Then, fitting structures that prevent a relative movement in the peripheral direction between the base case and the cover case are formed at two positions corresponding to a pair of the window portions facing each other in a radial direction of the second cylindrical wall portion among the n window portions. With this arrangement, relative rotation in the peripheral direction between the base case and the cover case may be prevented.

Corresponding to the n window portions formed in the second cylindrical wall portion of the cover case, n of the engaging projections are integrally formed with an outer wall part of the peripheral wall portion of the base case. Then, n slits are formed in the second cylindrical wall portion, having an open end and being radially opened, each located between two adjacent window portions. With this arrangement, when the n of the engaging projections enter into the second cylindrical wall portion, n portions of the second cylindrical wall portion between adjacent slits are pushed radially outwardly on the end side thereof. Relative passage of the n engaging projections is thereby facilitated.

When an annular projecting portion that compresses and depresses the waterproofing seal member is provided at the annular opposite surface that is formed at the boundary portion between the first cylindrical wall portion and the second cylindrical portion of the cover case and faces the waterproofing seal member, the divided connected portion between the base and cover cases may be satisfactorily sealed. The gap that receives the resin in particular may be readily formed between the annular opposite surface of the cover case and the waterproofing seal member. Then, the resin that has been entered into this gap and stops at an outer periphery of the annular projecting portion may securely seal the waterproofing seal member.

A surface of the waterproofing seal member that faces the end surface of the peripheral wall portion of the base case may be covered with a resin film. With this arrangement, the underside of the waterproofing seal member is protected by the resin film. Thus, durability of the annular watertight seal portion may be increased. Further, when the resin film is attached to the waterproofing seal member by an adhesive or the like, assembly is facilitated.

BEST MODE FOR CARRYING OUT THE INVENTION

Figure 1:
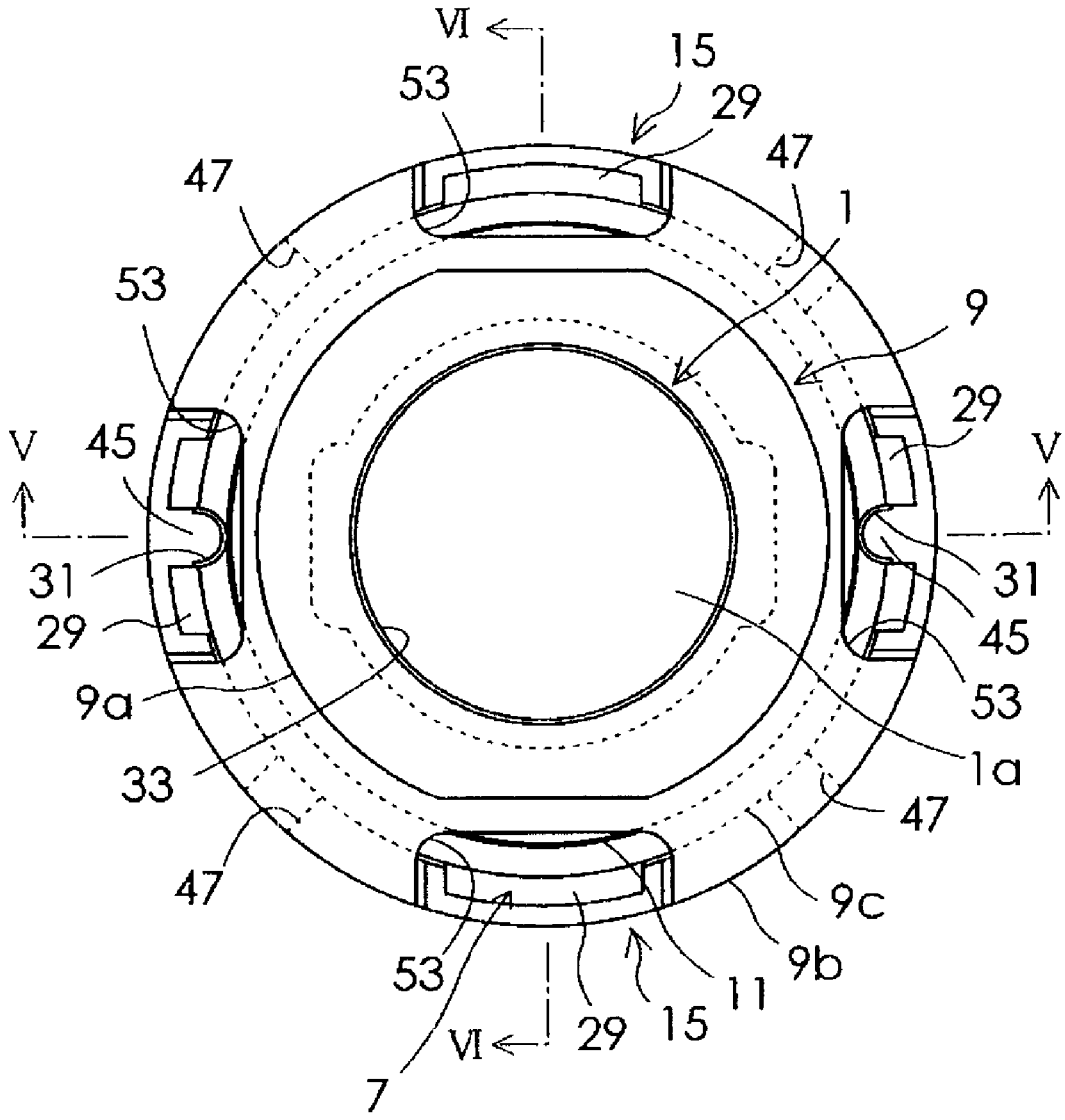
FIG. 1 is a plan view showing an embodiment of a waterproof push button switch according to the present invention.
Figure 2:
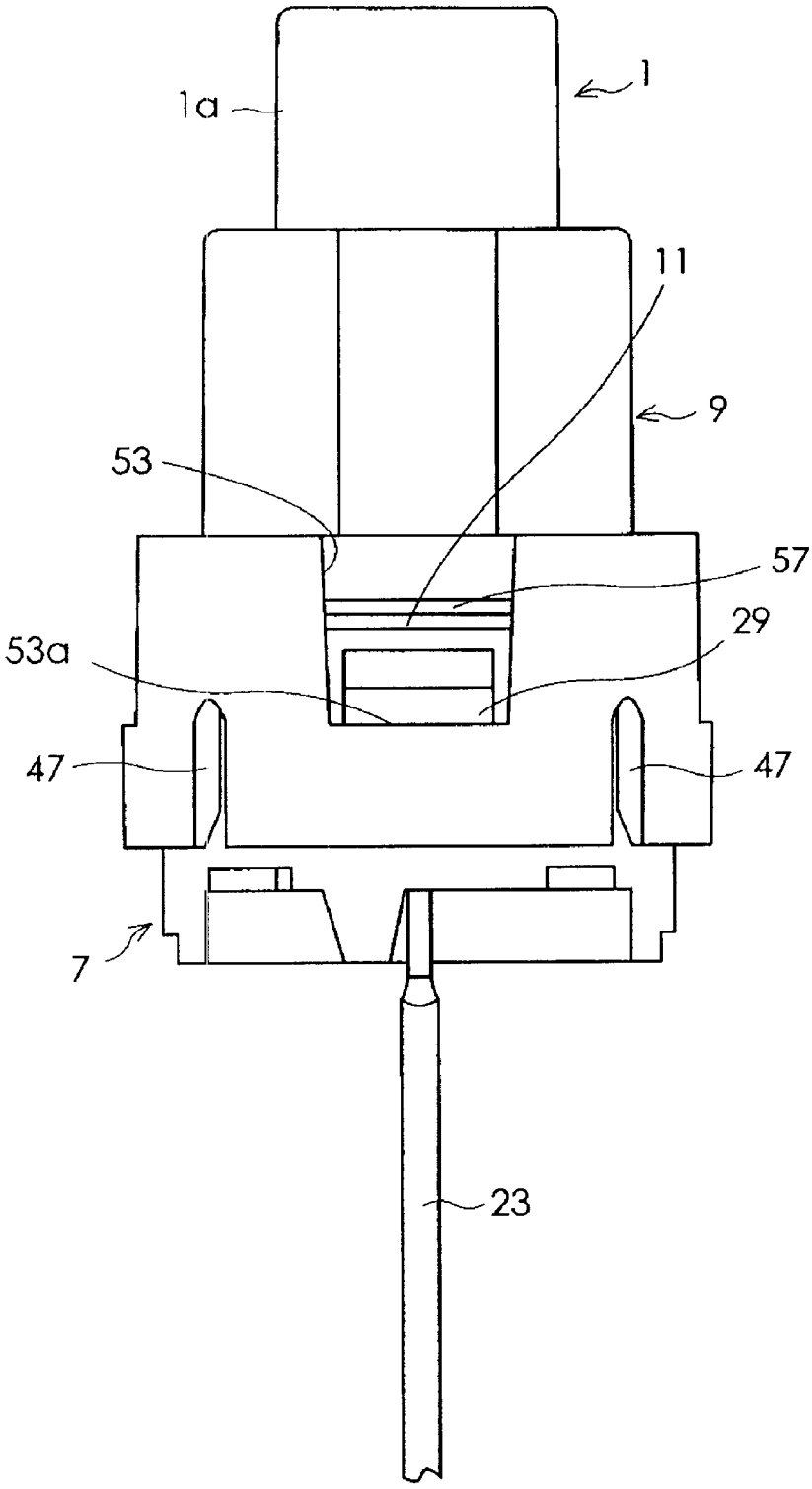
FIG. 2 is a front view of FIG. 1.
Figure 3:
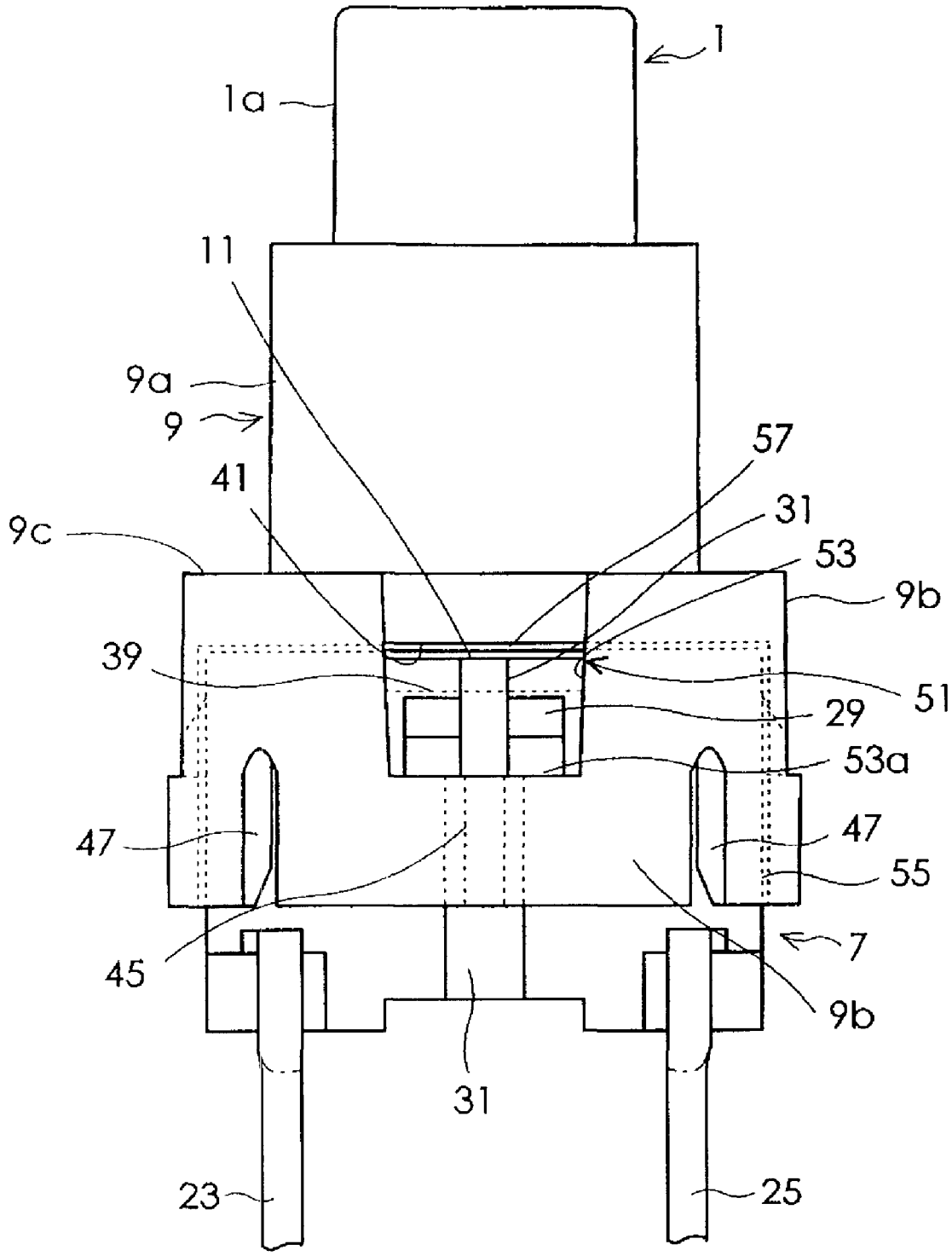
FIG. 3 is a right side view of FIG. 2.
Figure 4:
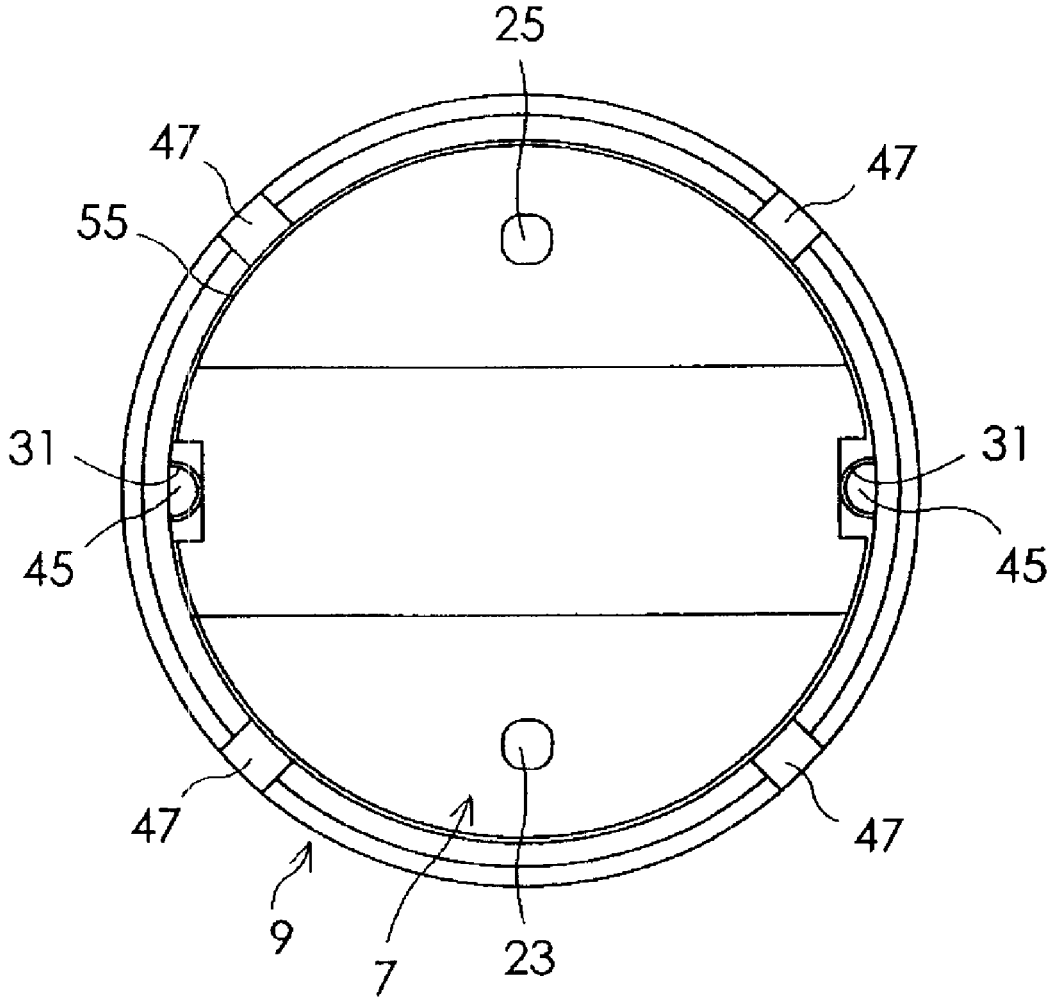
FIG. 4 is a bottom plan view of FIG. 1.
Figure 5:
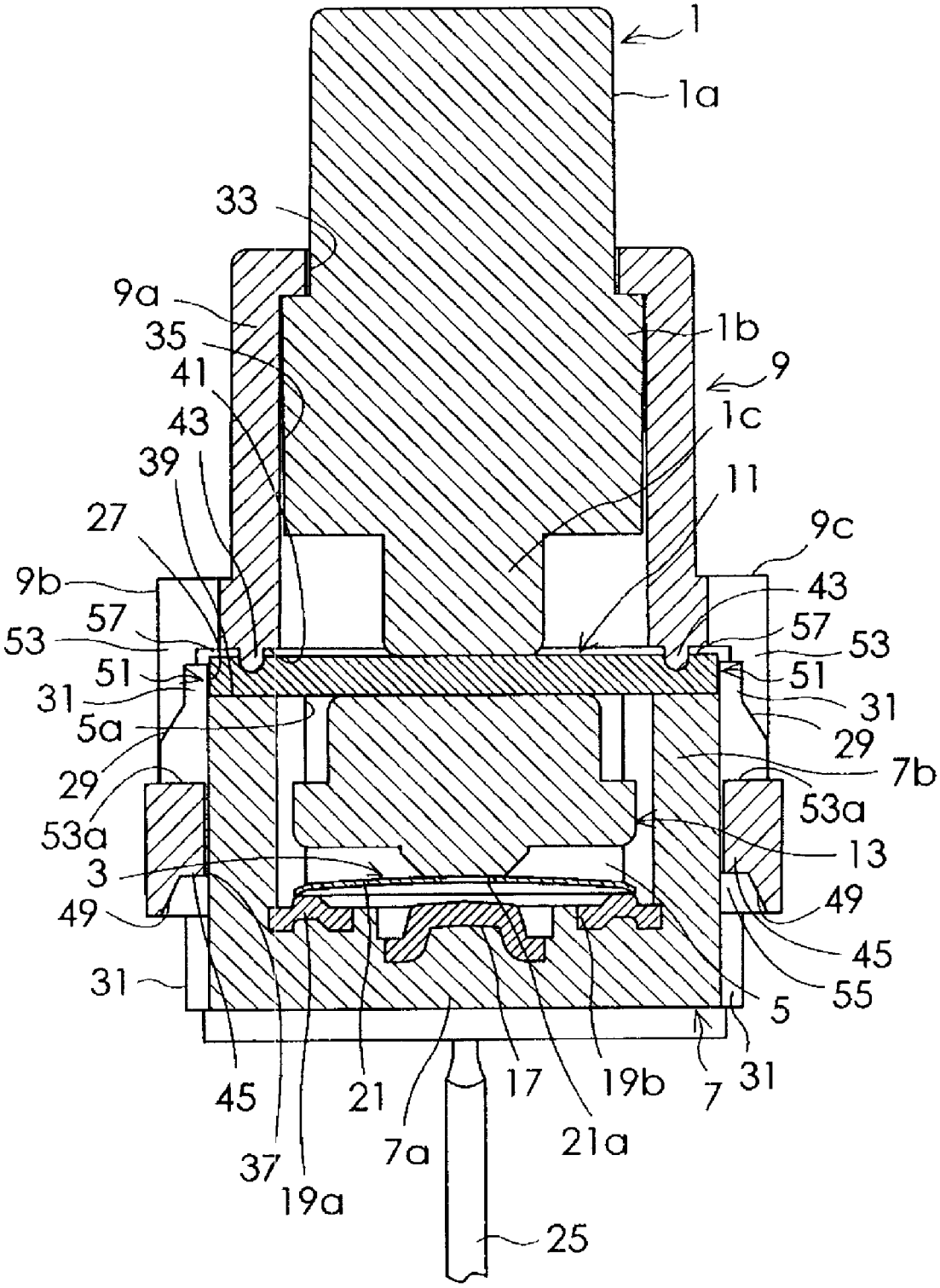
FIG. 5 is a sectional view taken along line V-V in FIG. 1.
Figure 6:
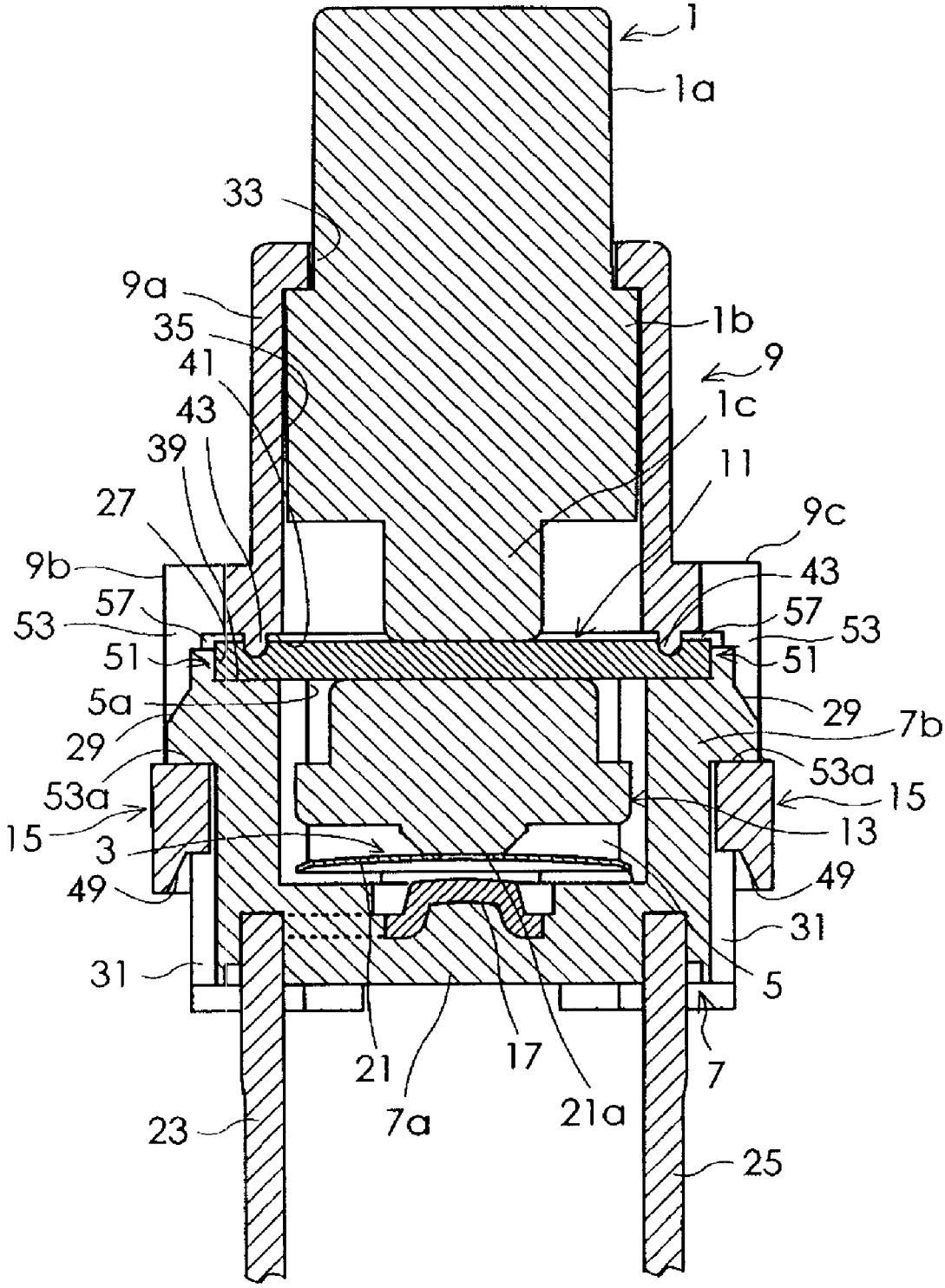
FIG. 6 is a sectional view taken along line VI-VI in FIG. 1.
Figure 7A:
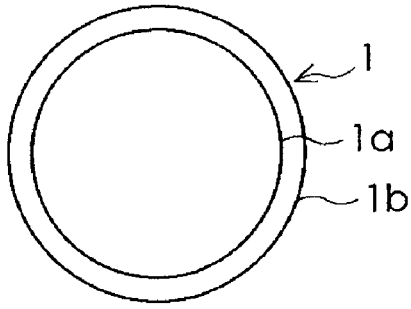
FIGS. 7A, 7B, and 7C are a top plan view, a front view, and a bottom plan view of a push button member used in the waterproof push button switch in this embodiment.
Figure 7B:
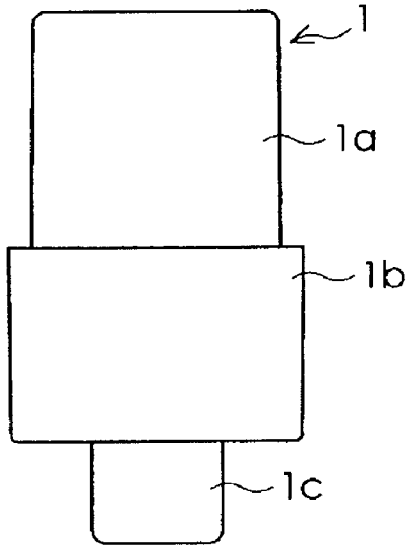
Figure 7C:
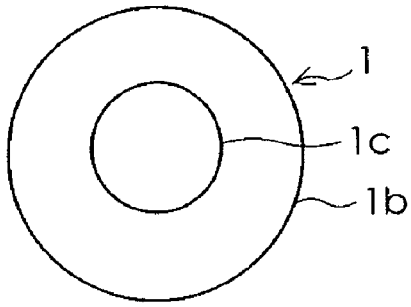
Figure 8A:
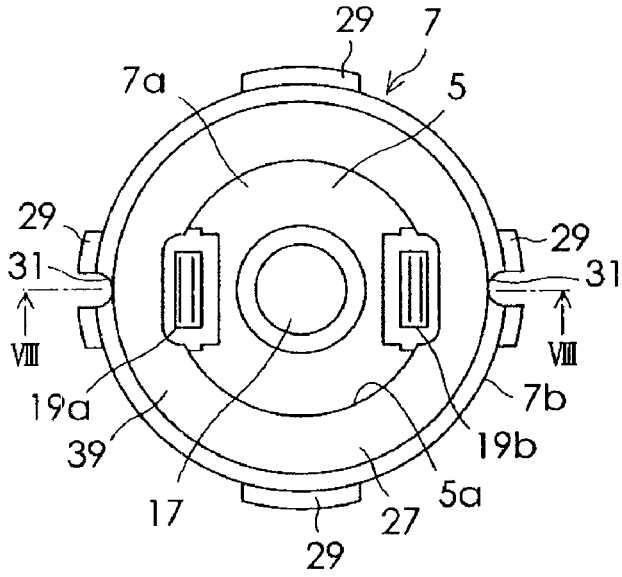
FIGS. 8A, 8B, and 8C are a top plan view, a right side view, and a bottom plan view of a base case used in the waterproof push button switch in this embodiment.
Figure 8B:
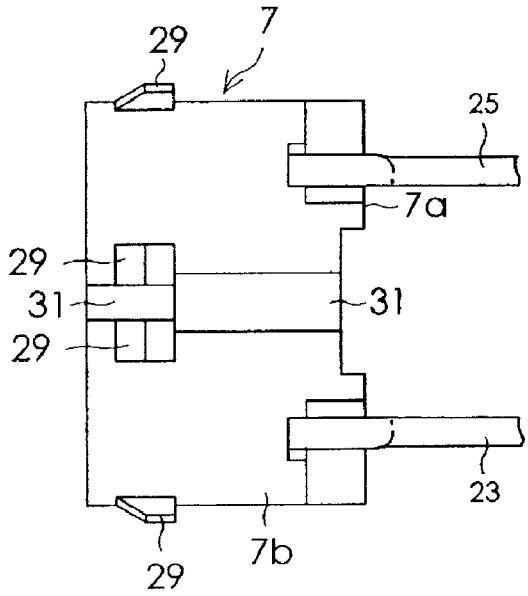
Figure 8C:
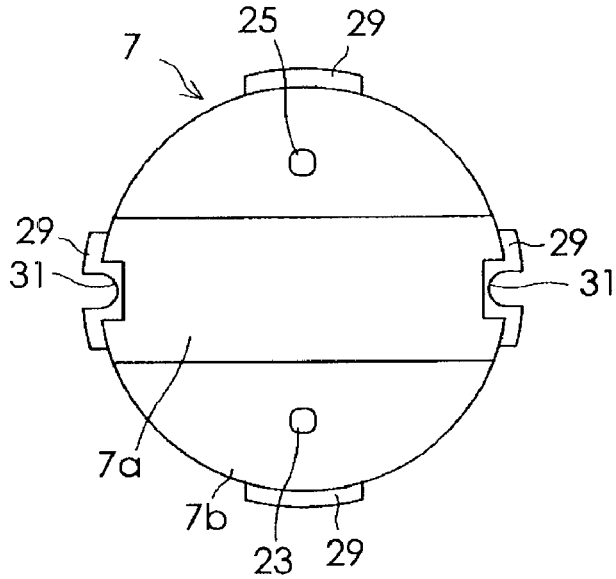
Figure 8D:
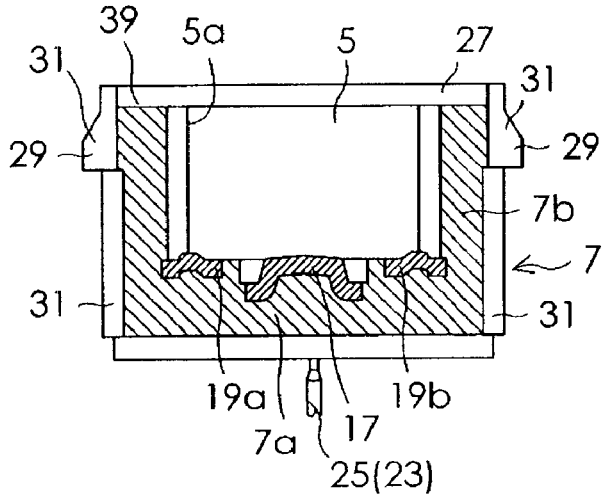
FIG. 8D is a sectional view taken along line VIII-VIII in FIG. 8A.
Figure 9A:
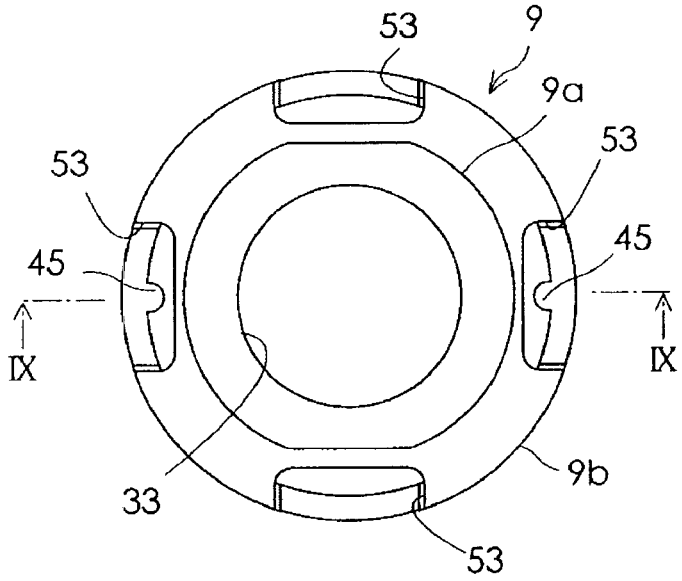
FIGS. 9A, 9B, and 9C are a top plan view, a right side view, and a bottom plan view of a cover case used in the waterproof push button switch in this embodiment.
Figure 9B:
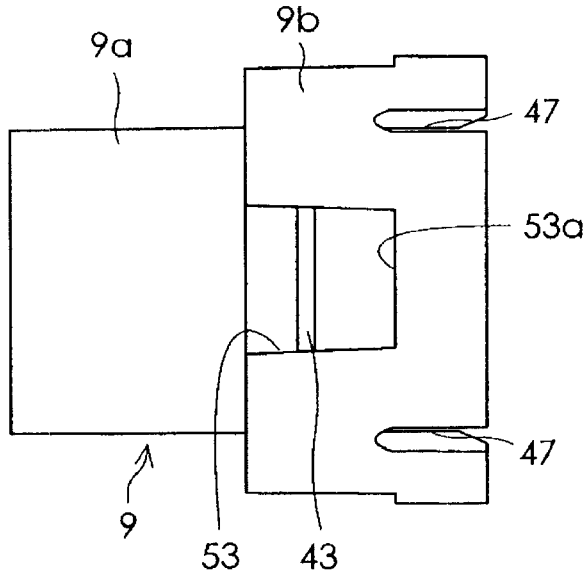
Figure 9C:
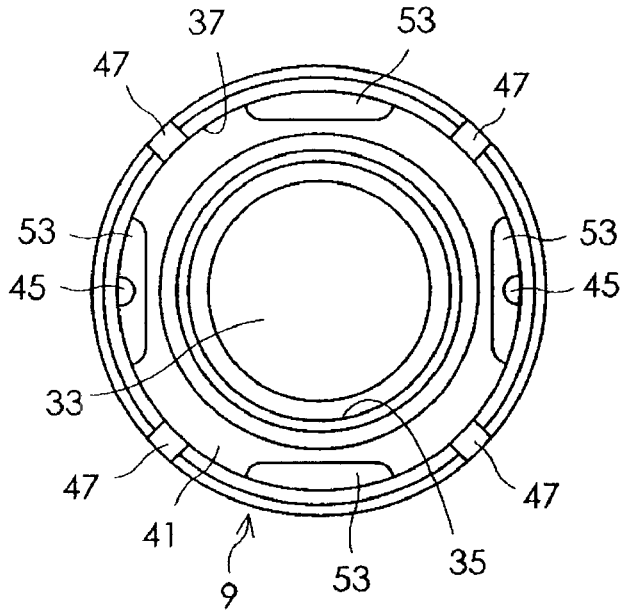
Figure 9D:
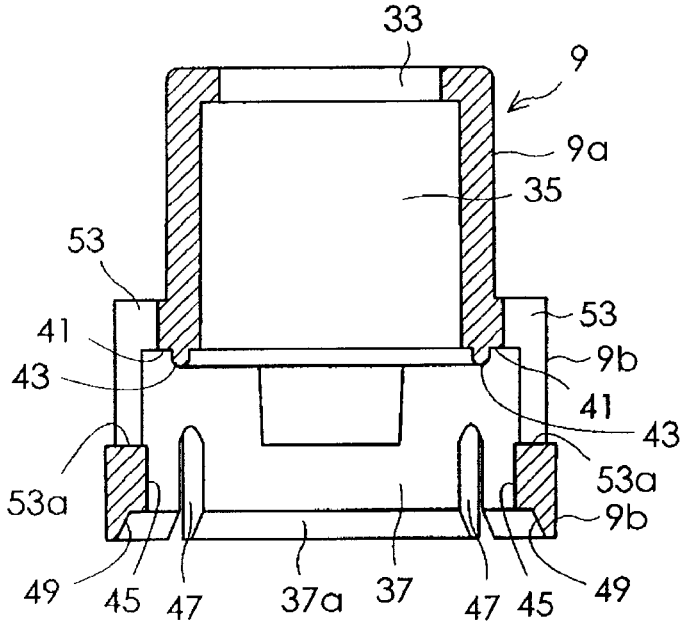
FIG. 9D is a sectional view taken along line IX-IX in FIG. 9A.
Figure 10A:
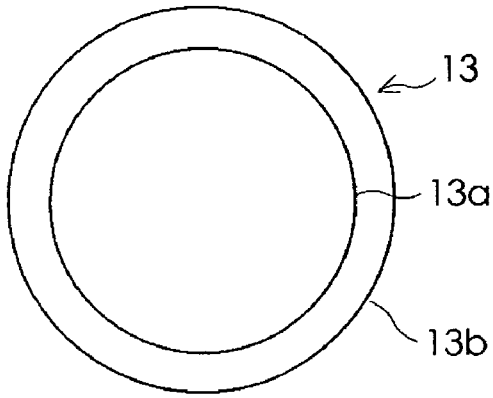
FIGS. 10A, 10B, and 10C are a top plan view, a partially vertical front view, and a bottom plan view of a plunger used in the waterproof push button switch in this embodiment.
Figure 10B:
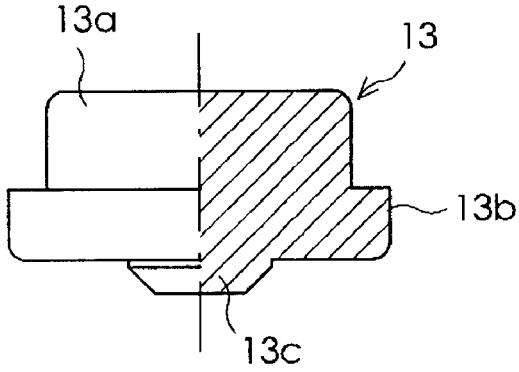
Figure 10C:
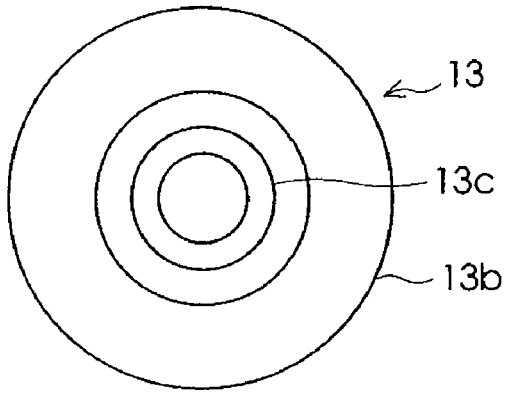

An embodiment of a waterproof push button switch according to the present invention will be described below in detail, with reference to drawings. FIG. 1 is a top plan view of the waterproof push button switch in this embodiment, FIG. 2 is a front view of FIG. 1, FIG. 3 is a right side view of FIG. 1, and FIG. 4 is a bottom plan view of FIG. 1. FIG. 5 is a sectional view taken along line V-V in FIG. 1, and FIG. 6 is a sectional view taken along line VI-VI in FIG. 1. FIGS. 7A, 7B, and 7C are a top plan view, a front view, and a bottom plan view of a push button member used in the waterproof push button in this embodiment. FIGS. 8A, 8B, and 8C are a top plan view, a right side view, and a bottom plan view of a base case used in the waterproof push button switch in this embodiment. FIG. 8D is a sectional view taken along line VIII-VIII in FIG. 8A. FIGS. 9A, 9B, and 9C are a top plan view, a right side view, and a bottom top view of a cover case used in the waterproof push button switch in this embodiment. FIG. 9D is a sectional view taken long line IX-IX in FIG. 9A. FIGS. 10A, 10B, and 10C are a top plan view, a partially vertical front view, and a bottom plan view of a plunger used in the waterproof push button in this embodiment.

As shown in FIGS. 1 through 6, the waterproof push button switch in this embodiment is configured to include a push button member 1 that receives a pushing force when operated, a switch mechanism 3 that is operated by the push button member 1, a base case 7 provided with a switch mechanism receiving chamber 5 that receives the switch mechanism 3, a cover case 9 that covers an opening portion 5*a* of the switch mechanism receiving chamber 5 in the base case 7, a waterproofing seal member 11 having elasticity for watertightly covering the opening portion 5*a* of the switch mechanism receiving chamber 5 in the base case 7, a plunger 13 that transmits the force pushed from the push button member 11 to the switch mechanism 3 through the waterproofing seal member 11, and a coupling mechanism 15 that couples the base case 7 and the cover case 9.

The push button member 1 is formed of a synthetic resin. As shown in FIGS. 5 through 7, the push button member 1 has a structure in which a cylindrical large-diameter portion 1*b* is concentrically and integrally provided under a cylindrical small-diameter portion 1*a*, and a cylindrical pushing portion 1*c* is concentrically and integrally provided under the large-diameter portion 1*b*. The push button member 1 is in a first position (raised position shown in FIGS. 5 and 6) when a pushing force is not applied. When the pushing force is applied, the push button member 1 is linearly moved from the first position to a second position (position lower than the first position).

As shown in FIGS. 5 and 8, the switch mechanism 3 that is operated by this push button member 1 is configured to include a central fixed contact 17, a pair of fixed contacts 19*a* and 19*b*, and a movable contact 21. The pair of fixed contacts 19*a* and 19*b* are aligned on both sides of the fixed contact 17 and are separated from the fixed contact 17 by an insulating interval. The movable contact 21 is constantly held in contact with these fixed contacts 19*a* and 19*b*. At a time of standby, the movable contact 21 is spaced apart from the central fixed contact 17. The movable contact 21 is arranged over these fixed contacts 19*a* and 19*b* and the fixed contact 17 in the shape of a dome. The movable contact 21 is formed by cutting an elastic metal plate made of phosphor bronze for spring or the like and then press-processing the cut metal plate into the dome shape, for example. In top of the movable contact shaped like the dome, an air vent hole 21*a* is formed. An outer diameter of the cylindrical pushing portion 1*c* of the push button member 1 is formed to be larger than the air vent hole 21*a*. When the convex top of the movable contact 21 that is shaped like the dome is depressed, the central portion of the movable contact 21 is elastically deflected, thereby coming into contact with the central fixed contact 17. Then, the fixed contacts 19*a* and 19*b* and the fixed contact 17 are short-circuited by the movable contact 21. The switch mechanism 3 is thereby turned on. When the pressure applied to the top of the movable contact 21 that is shaped like the dome is eliminated, the elastic deflection in the central portion of the movable contact 21 is reversed. Then, the movable contact 21 returns to its original shape. The top of the movable contact 21 is thereby separated from the central fixed contact 17, and the switch mechanism 3 is turned off. In other words, it is so arranged that, when the push button member 1 is in the second position, the switch mechanism 3 is turned on by the force applied from the push button member 1, and when the push button member 1 is not in the second position, the switch mechanism is turned off. This switch mechanism is incorporated into the base case 7 which will be described later. The switch mechanism 3 includes a terminal portion 23 connected to the fixed contact 17, and terminal portions 25 connected to the pair of the fixed contacts 19*a* and 19*b*.

The base case 7 is formed of a synthetic resin, and comprises a circular bottom wall portion 7*a* and a cylindrical peripheral wall portion 7*b* raised from an outer periphery of the circular bottom wall portion 7*a*, as shown in FIGS. 5, 6, and 8 in particular. The switch mechanism receiving chamber 5 is formed in an interior portion surrounded by the bottom wall portion 7*a* and the cylindrical peripheral wall portion 7*b*. The switch mechanism receiving chamber 5 in the base case 7 has the opening portion 5*a* that opens in a direction where the push button member 1 is located. In an end portion of the cylindrical peripheral wall portion 7*b*, a recessed portion 27 into which the waterproofing seal member 11 is fitted is annularly provided in a peripheral direction of the cylindrical peripheral wall portion 7*b*. On an upper outer periphery of the cylindrical peripheral wall portion 7*b*, n (herein four) engaging projections 29 that extend outwardly are integrally provided at intervals of 360°/n (herein 90° intervals)(n being an integer not less than two) in the peripheral direction. A pair of the engaging projections 29 are provided respectively on either side in a direction in which the fixed contacts 19*a* and 19*b* and the fixed contact 17 are aligned, the engaging portions 29 being opposed to each other. A stopper groove 31 is formed in each of the pair of the engaging projections 29 arranged in the alignment direction, at an intermediate position of the engaging projection in the peripheral direction. The stopper groove 31 extends along a direction in which the base case 7 is fitted into the cover case 9. Each stopper groove 31 is provided along an entire length of the cylindrical wall portion 7*b* in a height direction of the cylindrical peripheral wall portion 7*b*.

The fixed contacts 19*a* and 19*b* and the fixed contact 17 are arranged on the bottom wall portion 7*a* of the base case 7, with their lower portions embedded in the bottom wall portion 7*a* and with their upper portions exposed to the switch mechanism receiving chamber 5. The fixed contacts 19*a* and 19*b* and the fixed contact 17 as described above are insert-molded when the base case 7 is molded.

The cover case 9 is flexible because the cover case 9 is formed of a flexible synthetic resin. As shown in FIGS. 5, 6, and 9 in particular, the cover case 9 has a through-hole 33 through which a part of the push button member 1 slidably passes, and comprises a first cylindrical wall portion 9*a*, a second cylindrical wall portion 9*b*, and an annular opposite surface 41. The first cylindrical wall portion 9*a* includes a push button receiving chamber 35 which is continuously formed with the through-hole 33 and slidably receives the part of the push button member. The second cylindrical wall portion 9*b* is integrally formed with the first cylindrical wall portion 9*a* and includes abase case fitting chamber 37 that is continuously formed with the push button receiving chamber 35 and opens to a side opposite to the through-hole 33. The annular opposite surface 41 is formed at a boundary portion between the first cylindrical wall portion 9*a* and the second cylindrical wall portion 9*b* and faces an end surface 39 of the peripheral wall portion 7*b* of the base case 7. An annular projecting portion 43 which compresses and depresses the waterproofing shield member 11 is integrally provided with the annular opposite surface 41 that faces the waterproofing seal member 11 at the boundary portion between the first cylindrical wall portion 9*a* and the second cylindrical portion 9*b* of the cover case 9. Stopper projections 45 that are fitted into the stopper groove 31 in an outer periphery of the cylindrical peripheral wall portion 7*b* of the base case 7 are provided at an end inner surface of the second cylindrical wall portion 9*b* of the cover case 9. In an end of the second cylindrical wall portion 9*b* of the cover case 9, n (herein four) slits 47 that are radially opened are formed at intervals of 360°/n (herein 90° intervals) (n being an integer not less than two) in a peripheral direction of the cover case 9. Each of the n slits is located between adjacent two of n window portions that will be described later and has an open end. In this embodiment, the slit 47 is formed at location on either side of each stopper projection 45. The slit 47 is peripherally spaced from the stopper projection 45 by an angle of 45°, with its end opened. A tapered surface is provided on the end inner surface of the second cylindrical wall portion 9*b* of the cover case 9 along the peripheral direction. It is arranged that an inner diameter of the tapered surface 49 is the maximum at the end of the second cylindrical wall portion 9*b* and tapers more inwardly from the end of the second cylindrical wall portion 9*b*.

As shown in FIGS. 5 and 6 in particular, the waterproofing seal member 11 is formed of an elastic circular rubber plate. The waterproofing seal member 11 is fitted into the recessed portion 27 in an upper portion of the base case 7 along the peripheral direction of the base case 7, and covers the opening portion 5*a* of the base case 7. The depth of the recessed portion 27 is formed to be smaller than the thickness of the waterproofing seal member 11. Thus, when the waterproofing seal member 11 fitted into the recessed portion 27, an upper portion of the waterproofing seal member 11 is exposed on the recessed portion 27.

As shown in FIGS. 6, 8, and 9 in particular, the coupling mechanism 15 is structured to couple the second cylindrical wall portion 9*b* of the cover case 9 and the peripheral wall portion 7*b* of the base case 7, with the base case 7 fitted into the base case fitting chamber 37 of the cover case 9. The thickness of the waterproofing seal member 11 and the structure of the coupling mechanism 15 are determined so that the waterproofing seal member 11 is compressed to form an annular watertight seal portion 51 between the end surface 39 of the peripheral wall portion 7*b* of the base case 7 and the opposite surface 41 of the cover case 9, with the base case 7 fitted into the base case fitting chamber 37. The coupling mechanism 15 is constituted from n (herein four) window portions 53 and the n (herein four) engaging projections 29. The n window portions 53 are formed in the peripheral direction of the second cylindrical wall portion 9*b* at intervals of 360°/n (n being the integer not less than two) so that the n window portions 53 communicate with the base case fitting chamber 37. The n engaging projections are formed integrally with and outwardly from an outer wall part of the peripheral wall portion 7*b* of the base case 7. The engaging projections 29 deform the second cylindrical wall portion 9*b* to push it radially outwardly when the base case 7 gets fitted into the base case fitting chamber 37. The n engaging projections 29 are fitted in the window portions 53 and are engaged with borders 53*a* of the window portions 53 when the base case 7 is completely fitted into the base case fitting chamber 37. Each of these window portions is formed to extend to an upper end of the stopper projection 45 from an upper surface of a step portion 9*c* that connects the first cylindrical wall portion 9*a* and the second cylindrical wall portion 9*b* of a diameter larger than that of the first cylindrical wall portion 9*a* of the cover case 9. The window portions 53 are formed to expose a part of an outer peripheral surface of the waterproofing seal member 11 therefrom. In this embodiment, four window portions 53 are formed at positions spaced by an angle of 90° in the peripheral direction of the second cylindrical wall portion 9*b*. These four window portions 53 are provided, corresponding to the four engaging projections 29 of the base case 7. At two locations on an inner surface of the second cylindrical wall portion 9*b* corresponding to a pair of the window portions 53 that face to each other in a radial direction of the second cylindrical wall portion 9*b* among the four window portions 53, the stopper projections 45 that prevent a relative movement of the cover case in the peripheral direction are formed.

The plunger 13 that transmits a force pushed from the push button member 11 to the movable contact 21 of the dome shape in the switch mechanism 3 through the waterproofing seal member 11 is formed of a synthetic resin. As shown in FIGS. 5, 6, and 10A to 10C in particular, the plunger 13 has a structure in which a cylindrical large-diameter portion 13*b* is concentrically and integrally provided under a cylindrical small-diameter portion 13*a* and a pushing portion 13*c* of a truncated cone shape is concentrically and integrally provided under the large-diameter portion 13*b*. An upper surface of the cylindrical small-diameter portion 13*a* is brought into contact with the underside of the waterproofing seal member 11 and then an end of the pressure portion 13*c* of the truncated cone shape is brought into contact with the top of the movable contact 21 of the dome shape. This plunger 13 is thereby configured to transmit a pushing force from the push button member 1 to the movable contact 21 of the dome shape through the waterproofing seal member 11 and the plunger 13.

is

In this waterproof push button switch in particular, between the peripheral wall portion 7*b* of the base case 7 and the second cylindrical wall portion 9*b* of the cover case 9 and between the opposite surface 41 and the waterproofing seal member 11, a gap (55, 57) (refer to FIGS. 3 and 4) (refer to FIGS. 2, 3, 5, and 6) is formed. The gap (55, 57) extends from an opening portion 37*a* of the base case fitting chamber 37 to the annular watertight seal portion 51 to completely surround a periphery of the watertight seal portion 51. The thickness of the gap (55, 57) is determined to allow a resin entered into the gap portion 55 from the opening portion 37*a* of the base case fitting chamber 37 to reach the gap portion 57 at the watertight seal portion 51 by surface tension (or capillary phenomenon).

Figure 11:
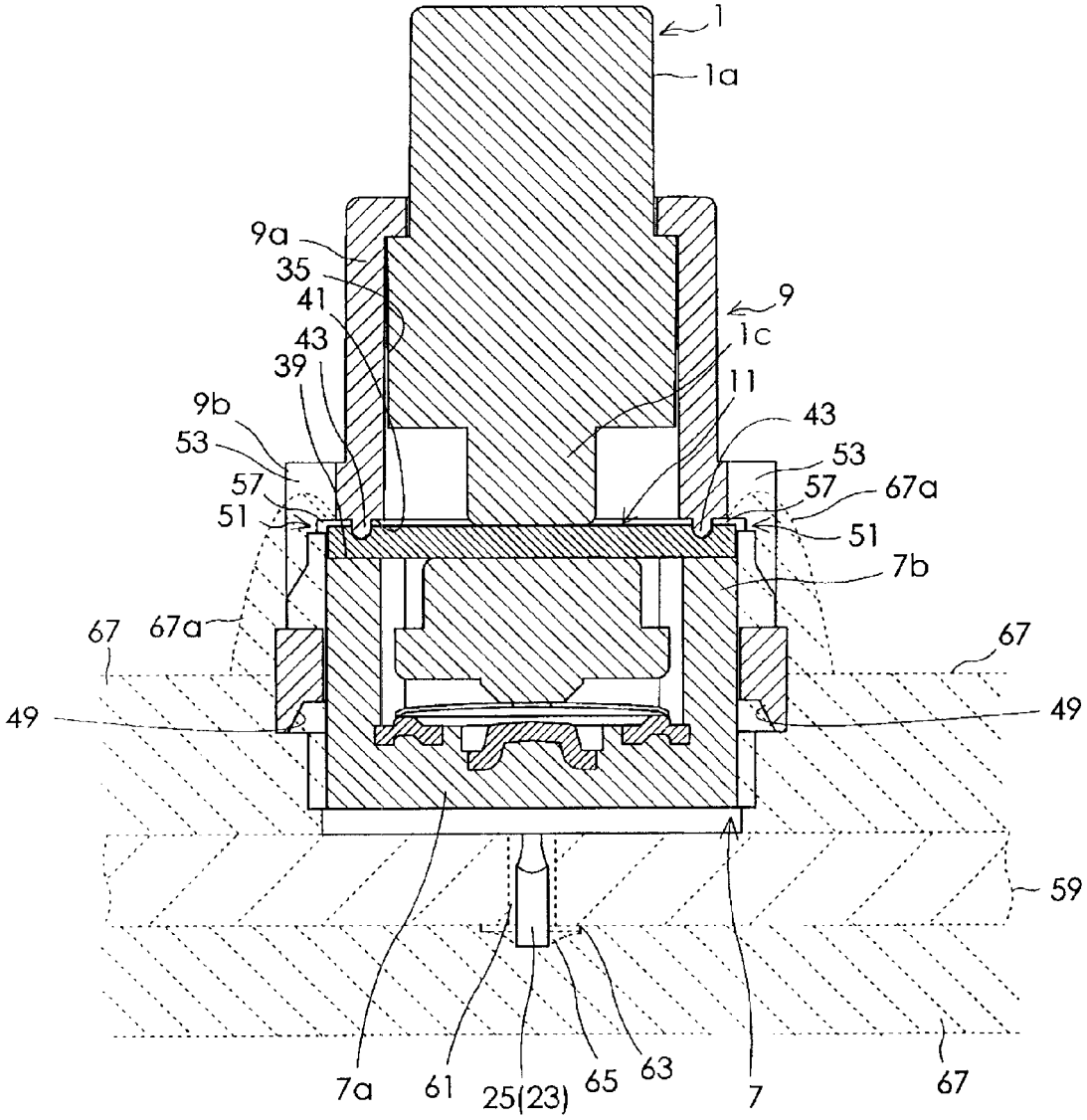
FIG. 11 is an explanatory diagram showing a process in which the waterproof push button switch in this embodiment is mounted on a circuit substrate and covered with a resin.

As shown in FIG. 11, the terminal portions 23 and 25 are cut to a length at which tips of the terminal portions 23 and 25 are exposed from the undersurface of the circuit substrate 59 just by a predetermined size. Then, the terminal portions 23 and 25 are passed through through-holes 61 of the circuit substrate 59 and are connected to a conductive layer 63 of the circuit substrate 59 using solder 65. Then, both surfaces of the circuit substrate 59 are covered with a resin 67. The covering thickness of the resin 67 on a side where the waterproof push button switch is present is determined to allow a lower end of the second cylindrical wall portion 9*b* of the cover case 9 to be hidden in the layer of the resin 67. With this arrangement, the resin 67 rises through the gap portion 55 between the peripheral wall portion 7*b* of the base case 7 and the second cylindrical wall portion 9*b* of the cover case 9 by surface tension, completely surrounds the watertight seal portion 51, enters into the gap portion 57 between the opposite surface 41 of the cover case 9 and the waterproofing seal member 11, and then stops at the annular projecting portion 43 of the opposite surface 41 of the cover case 9. The watertight seal portion 51 is further sealed by the resin 67 at the watertight seal portion 51. Sealing is thereby ensured. When the sealing is ensured, the resin 67 overflows from the window portions 53, thereby forming overflow resin portions 67*a*. When these overflow resin portions 67*a* are formed, covering with the resin 67 is finished.

For this reason, the covering thickness of the resin 67 that covers the surfaces of the circuit substrate 59 should be a depth at which the end of the second cylindrical wall portion 9*b* of the cover case 9 is embedded in the resin 67. Accordingly, it is not necessary to cover the waterproof push button switch with the resin 67 to a height at which a connection between the divided parts (connection between the base case 7 and the cover case 9 in this embodiment) midway in a height direction of the case of the switch is hidden. An amount of the resin 67 to be used is thereby reduced, and the cost may be thereby reduced.

The numbers of the window portions 53 and the engaging projections 29 are not limited to four, but should not be less than two.

Figure 12:
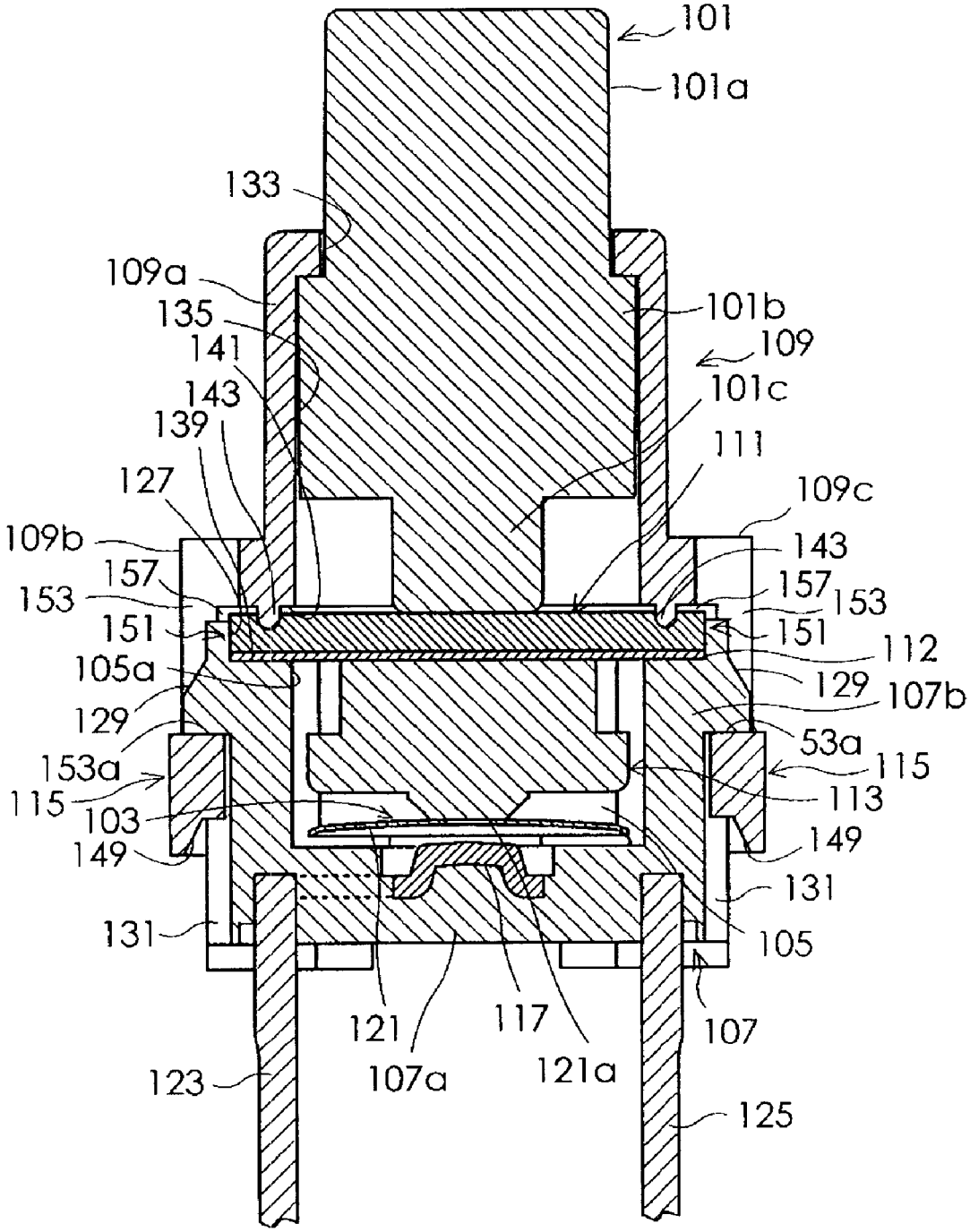
FIG. 12 is a sectional view showing another embodiment of a waterproof push button switch according to the present invention.

FIG. 12 is a diagram explaining another embodiment example of a waterproof push button switch according to the present invention. Referring to FIG. 12, to components that are the same as those explained with reference to FIG. 6, reference numerals obtained by adding 100 to reference numerals shown in FIG. 6 are assigned. Then, descriptions of the components will be omitted. In the another example in this embodiment, as shown in FIG. 12, the underside of a waterproofing seal member 111 (surface that faces an end surface 139 of a peripheral wall portion 107*b* of a base case 107) is covered with a resin film. As the resin film, a material that protects the waterproofing seal member 111 may be used so that durability of an annular watertight seal portion 151 is increased. In this example, a polyester polymer film is used as a resin film 112. The resin film 112 (polyester polymer film) is attached to the waterproofing seal member 111 by an adhesive so that the resin film 112 covers the entire underside of the waterproofing seal member 111.

The thickness of the resin film 112 is determined so that a resin entered into a gap portion from an opening portion of a base case fitting chamber reaches the gap portion 157 of the watertight seal portion 151 by surface tension (or capillary phenomenon), with the underside of the waterproofing seal member 111 covered with the resin film 112 (refer to reference numerals 37 and 55 in FIG. 5 and reference numeral 37*a* in FIG. 9D). In this example, the thickness of the resin film 112 is set to 105 μm.

The resin film (polyester polymer film) 112 does not need to be attached to the waterproofing seal member 111.

INDUSTRIAL APPLICABILITY

In the waterproof push button switch according to the present invention, a gap is formed between the peripheral wall portion of the base case and the second cylindrical wall portion of the cover case and between the opposite surface and the waterproofing seal member. The gap extends from the opening portion of the base case fitting chamber to the annular watertight seal portion to completely surround the watertight seal portion. Then, the thickness of the gap is determined so that a resin entered into the gap from the opening portion of the base case fitting chamber reaches the watertight seal portion by surface tension. Accordingly, when the end of the second cylindrical wall portion of the cover case enters into a surface of the resin at a time of mounting this waterproof push button switch on the circuit substrate together with other electronic components and then covering the surfaces of the circuit substrate with the resin, the resin rises through the gap between the peripheral wall portion of the base case and the second cylindrical wall portion of the cover case, by the surface tension. The resin thereby completely surrounds the watertight seal portion. For this reason, the covering thickness of the resin that covers the surfaces of the circuit substrate should be a depth at which the end of the second cylindrical wall portion of the cover case is embedded in the resin. Thus, it is not necessary to cover the waterproof push button switch with the resin to a height at which the divided connected portion midway in the direction of height of the case for the switch is hidden by the resin. The amount of use of the resin may be thereby reduced, and the cost may be therefore reduced.

The invention claimed is:

1. A waterproof push button switch comprising:

a push button member that is in a first position when a pushing force is not applied, and is linearly moved from the first position to a second position when the pushing force is applied;

a switch mechanism that is turned on by the force applied from the push button member when the push button member is in the second position, and is turned off when the push button member is not in the second position;

a base case comprising a bottom wall portion and a cylindrical peripheral wall portion, and provided with a switch mechanism receiving chamber that has an opening portion, which opens in a direction where the push button member is located, and receives the switch mechanism;

a cover case having a through-hole through which a part of the push button member slidably passes, and comprising:

a first cylindrical wall portion including a push button receiving chamber continuously formed with the through-hole and slidably receiving the part of the push button member;

a second cylindrical wall portion integrally formed with the first cylindrical wall portion and including a base case fitting chamber that is continuously formed with the push button receiving chamber and opens to a side opposite to the through-hole; and an annular opposite surface that is formed at a boundary portion between the first cylindrical wall portion and the second cylindrical wall portion and faces an end surface of the peripheral wall portion of the base case;

a waterproofing seal member that is elastic and is arranged and compressed between the end surface of the peripheral wall portion of the base case and the opposite surface of the cover case to cover the opening portion of the base case; and a coupling mechanism that couples the second cylindrical wall portion of the cover case and the peripheral wall portion of the base case, with the base case fitted into the base case fitting chamber of the cover case, wherein a thickness of the waterproofing seal member and a structure of the coupling mechanism are determined so that the waterproofing seal member is compressed to form an annular watertight seal portion between the end surface of the peripheral wall portion of the base case and the opposite surface of the cover case, with the base case fitted into the base case fitting chamber;

a gap is formed between the peripheral wall portion of the base case and the second cylindrical wall portion of the cover case and between the opposite surface and the waterproofing seal member, the gap extending from an opening portion of the base case fitting chamber to the annular watertight seal portion to completely surround the watertight seal portion; and a thickness of the gap is determined to allow a resin entered into the gap from the opening portion of the base case fitting chamber to reach the watertight seal portion by surface tension;

the cover case is integrally formed of a flexible synthetic resin material;

a plurality of window portions that communicate with the base case fitting chamber are formed in the second cylindrical wall portion of the cover case in a peripheral direction of the second cylindrical wall portion at predetermined intervals;

a plurality of engaging proiections are formed integrally with and outwardly from the peripheral wall portion of the base case, the engaging proiections deforming the second cylindrical wall portion to push it radially outwardly when the base case gets fitted into the base case fitting chamber, and being fitted in the window portions and engaged with borders of the window portions when the base case is completely fitted into the base case fitting chamber;

the coupling mechanism is constituted from the borders of the window portions and the engaging projections; and the window portions are formed to expose a part of an outer peripheral surface of the waterproofing seal member therefrom.

2. The waterproof push button switch according to claim 1, wherein the window portions comprise n window portions formed at positions spaced by 360°/n (n being an integer not less than two) in the peripheral direction; and fitting structures that prevent a relative movement in the peripheral direction between the base case and the cover case are formed at two positions corresponding to a pair of the window portions facing each other in a radial direction of the second cylindrical wall portion among the n window portions.

3. The waterproof push button switch according to claim 2, wherein n of the engaging projections are integrally formed with the peripheral wall portion of the base case, corresponding to the n window portions formed in the second cylindrical wall portion of the cover case, and n slits are formed in the second cylindrical wall portion, having an open end and being radially opened, each located between two adjacent window portions.

4. The waterproof push button switch according to claim 1, wherein an annular projecting portion that compresses and depresses the waterproofing seal member is provided at the annular opposite surface that is formed at the boundary portion between the first cylindrical wall portion and the second cylindrical portion of the cover case and faces the waterproofing seal member.

5. The waterproof push button switch according to claim 1, wherein a surface of the waterproofing seal member that faces the end surface of the peripheral wall portion of the base case is covered with a resin film.

6. The waterproof push button according to claim 5, wherein the resin film is attached to the waterproofing seal member.

* * * * *